US007823435B2

(12) United States Patent
Bandou et al.

(10) Patent No.: US 7,823,435 B2
(45) Date of Patent: Nov. 2, 2010

(54) DIE CLAMP MECHANISM FOR PRESS MACHINE

(75) Inventors: Eigo Bandou, Nomi (JP); Katsuhiro Takano, Komatsu (JP)

(73) Assignee: Komatsu Ltd, Tokyo (JP)

( * ) Notice: Subject to any disclaimer, the term of this patent is extended or adjusted under 35 U.S.C. 154(b) by 0 days.

(21) Appl. No.: 12/184,552

(22) Filed: Aug. 1, 2008

(65) Prior Publication Data

US 2009/0031780 A1 Feb. 5, 2009

(30) Foreign Application Priority Data

Aug. 2, 2007 (JP) ..... 2007-201837

(51) Int. Cl.
*B21D 37/00* (2006.01)

(52) U.S. Cl. ..... 72/482.6; 72/448; 72/481.6; 72/482.92

(58) Field of Classification Search ..... 72/446, 72/448, 481.1–481.8, 482.6, 482.92
See application file for complete search history.

(56) References Cited

U.S. PATENT DOCUMENTS 4,187,713 A * 2/1980 Fellner ..... 72/446
5,000,022 A * 3/1991 Shinkai et al. ..... 72/21.1
5,860,315 A * 1/1999 Sawdon ..... 72/481.8
6,463,839 B2 * 10/2002 Ohtsuka et al. ..... 83/698.91
6,483,839 B1 * 11/2002 Gemar et al. ..... 370/395.42

FOREIGN PATENT DOCUMENTS

JP 2002-331323 A 11/2002
JP 2004-136293 A 5/2004
JP 2004-268186 A 9/2004

* cited by examiner

*Primary Examiner*—Edward Tolan
(74) *Attorney, Agent, or Firm*—Holtz, Holtz, Goodman & Chick, PC

(57) ABSTRACT

A die clamp mechanism includes: a plunger that protrudes from a lower side of a carrier when the carrier on which a bolster is mounted is separated from a bed of a press machine and plunges into the lower side of the carrier when the carrier is grounded on the bed; a biasing member that biases the plunger downward; and an engaging member that engages a die with the bolster in accordance with an axial movement of the plunger when the plunger plunges into the lower side of the carrier.

7 Claims, 9 Drawing Sheets

DIE CLAMP MECHANISM FOR PRESS MACHINE

BACKGROUND OF THE INVENTION

1. Field of the Invention

The present invention relates to a die clamp mechanism for a press machine. Specifically, it relates to a clamp mechanism of a moving bolster.

2. Description of Related Art

Conventionally, a die is located on a bolster provided on a press machine and a T-slot provided on the bolster is utilized to fix the die, whereby the die is fixed by a hydraulic clamp mechanism, a clamp member and the like (Document 1: JP-A-2002-331323, Document 2: JP-A-2004-268186, Document 3: JP-A-2004-136293).

However, as disclosed in Documents 1 and 2, power source such as hydraulic fluid required for locating and fixing the die by the hydraulic clamp mechanism has resulted in soaring production costs. A lot of time has also been required for preparatory process since a series of operations such as clamping and unclamping have been needed for fixing the die by the clamp member and the like as disclosed in Document 3. Further, clamping work as disclosed in Documents 1, 2 and 3 has required manned operation, which has caused considerable labor costs.

SUMMARY OF THE INVENTION

An object of the present invention is to provide a die clamp mechanism for a press machine that does not require power source or the like and realizes unmanned clamping/unclamping operation to significantly reduce total cost.

A die clamp mechanism for a press machine according to an aspect of the present invention includes: a plunger that protrudes from a lower side of a carrier when the carrier on which a bolster is mounted is separated from a bed of the press machine and plunges into the lower side of the carrier when the carrier is grounded on the bed; a bias member that biases the plunger downward; and an engaging member that engages a die with the bolster in accordance with an axial movement of the plunger when the plunger plunges into the lower side of the carrier.

According to the aspect of the present invention, when a moving bolster including the bolster and the carrier is grounded on the bed of the press machine, the plunger is moved upward so that the die is engaged with the engaging member. When the moving bolster is separated from the bed for unclamping, the plunger is moved downward by a downward biasing force of the biasing member so that the die is disengaged. Accordingly, the die is automatically clamped or unclamped in accordance with the axial movement of the plunger. Consequently, for clamping and unclamping the die, devices such as a hydraulic clamp mechanism are not necessary and power source or the like is also not necessary. This allows production costs to be reduced. Also, unmanned operation for clamping and unclamping can be realized, which allows total cost to be significantly reduced. Thus, an object of the present invention can be achieved.

The die clamp mechanism for the press machine preferably further includes: a concave portion provided on a lower side of the die; and an insert member that protrudes upward from an upper side of the bolster and is inserted into the concave portion from below when the die is mounted on the upper side of the bolster, in which the engaging member engages the die with the insert member in accordance with the axial movement of the plunger when the plunger plunges into the lower side of the carrier.

In this arrangement, the plunger is inserted into the insert member to be axially slidable. When the plunger is moved upward, the plunger is inserted into the concave portion provided on the lower side of the die so that the die is engaged with the engaging member.

It is preferable that an engagement portion engaged with the engaging member is provided on a lower portion of the concave portion, an axial through hole into which the plunger is insertable and a plurality of horizontal ball-accommodating portions penetrating from an inner circumference to an outer circumference of the upper end of the insert member are provided in the insert member, the engaging member is a ball accommodated in the respective ball-accommodating portions, a small-diameter portion is provided on an upper end of the plunger, and the ball is brought into contact with the small-diameter portion and plungeable from the outer circumference of the plunger when the plunger protrudes from the lower side of the carrier, and the ball is brought into contact with the outer circumference of the insert member of which diameter is larger than the small-diameter portion and protrudes from the outer circumference of the plunger to be engaged with the engagement portion when the plunger plunges into the lower side of the carrier.

In this arrangement, the plunger is inserted into the through hole of the insert member to be axially slidable. When the moving bolster is grounded on or separated from the bed, the ball (i.e. the engaging member) protrudes outward from the outer circumference of the upper end of the plunger or is accommodated in the ball-accommodating portion. Consequently, the ball is engaged with or disengaged from the engagement portion so that the die is automatically clamped or unclamped.

Preferably, the engaging member is a lever abutted on the upper end of the plunger, the die clamp mechanism comprises a supporting member that connects the lever by a pin, and the lever is disengaged from the die when the plunger protrudes from the lower side of the carrier and the lever is pushed up by the plunger to be engaged with the die when the plunger plunges into the lower side of the carrier.

The lever according to the above arrangement is connected to the supporting member by the pin to be rotatable. When the moving bolster is grounded on or separated from the bed, the plunger is moved upward to push up the lever abutted on the upper end of the plunger or is moved downward by the weight of the plunger itself and the biasing force of the biasing member. Accordingly, the lever is engaged with or disengaged from the die so that the die is automatically clamped or unclamped.

Preferably, the engaging member is a lever abutted on an upper end of the plunger, the die clamp mechanism comprises a connector screwed on an end portion of the plunger through the lever and a pressing member that protrudes on an upper end of the connector, and the lever is pushed down to be disengaged from the die when the plunger protrudes from the lower side of the carrier and the lever is pushed up by the plunger to be engaged with the die when the plunger plunges into the lower side of the carrier.

In this arrangement, the pressing member attached to the connector screwed to the upper end of the plunger is axially moved in accordance with the axial movement of the plunger. Accordingly, when the moving bolster is separated from the bed, the plunger is moved downward so that the lever is pushed down by the pressing member. Therefore, the lever is disengaged from or engaged with the die similarly to the above arrangement so that the die is automatically clamped or unclamped.

The die clamp mechanism for the press machine preferably further includes: a first nut member provided protrudably and retractably from the lower side of the carrier; a screw member, a lower portion of which is screwed to the first nut member; and a second nut member screwed to an upper portion of the screw member, in which the second nut member is attached to the plunger, and a lead of the second nut member is longer than a lead of the first nut member.

In this arrangement, since the lead of the second nut member is longer than the lead of the first nut member, a movement of the second nut member is amplified when the second nut member is moved in accordance with a movement of the first nut member. Accordingly, even when the moving distance of the first nut member, i.e. the grounding stroke, is short, an upward moving distance of the second nut member and consequently an upward moving distance of the plunger are reliably secured.

The die clamp mechanism for the press machine preferably still further includes: a locating pin provided protrudably and retractably from the lower side of the carrier; and a link mechanism that transfers an axial movement of the locating pin to the plunger, in which the link mechanism includes a first link member, an upper portion of which is attached to the plunger, a swinging link member pivotally attached to a lower portion of the first link member on one end and swinging around the other end, and a second link member, an upper portion of which is connected to a middle portion of the swinging link member in a longitudinal direction and a lower portion of which is attached to the locating pin.

In the link mechanism between the plunger and the locating pin with this arrangement, the movement of the locating pin transmitted to the plunger is amplified by a leverage at each connecting portion of the swinging link. Consequently, the upward moving distance of the plunger is reliably secured even when the grounding stroke is short similarly to the above-described aspect of the present invention.

DETAILED DESCRIPTION OF PREFERRED EMBODIMENT(S)

Figure 1:
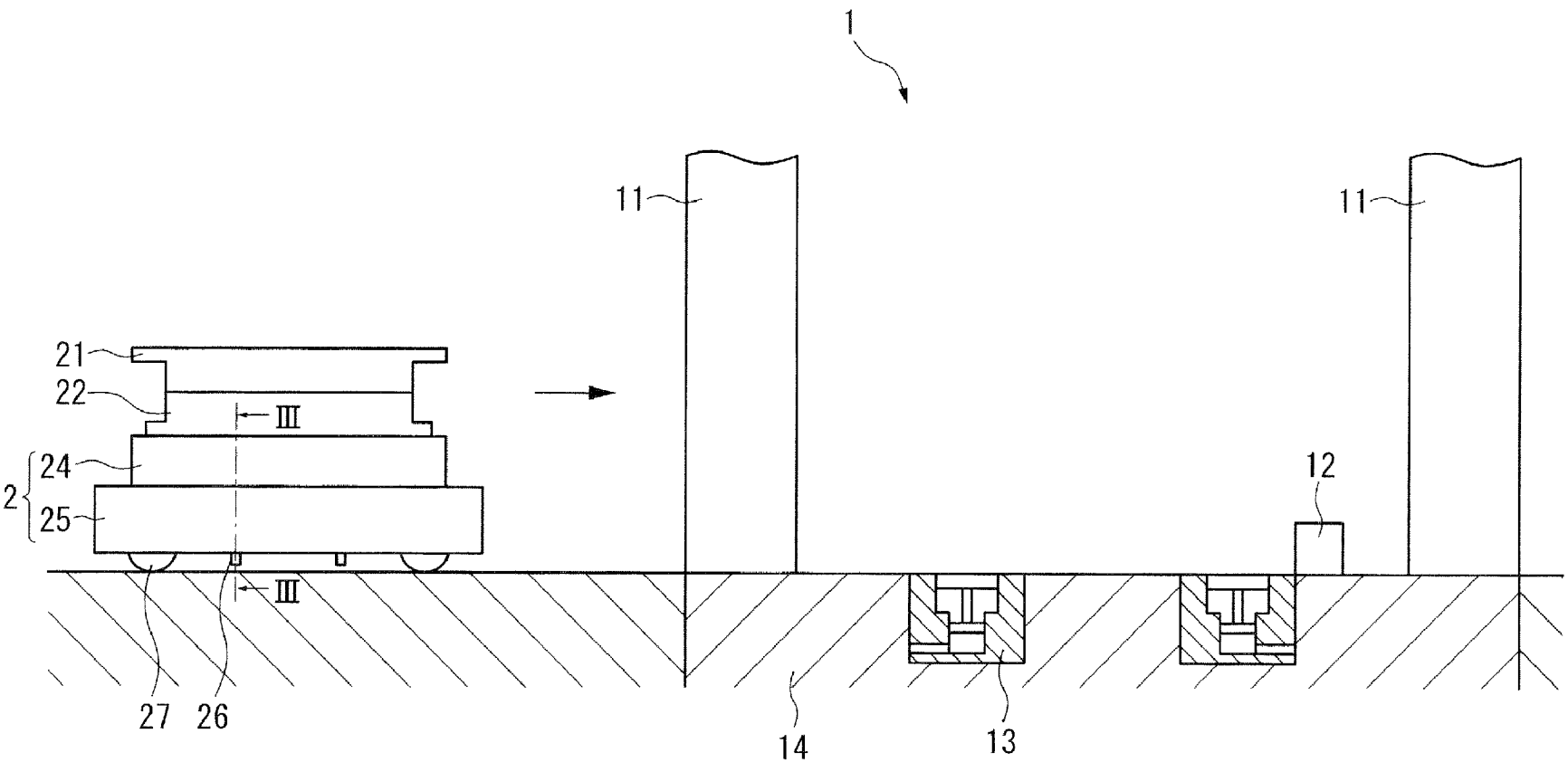
FIG. 1 is a schematic view showing how a moving bolster having a die clamp mechanism according to a first exemplary embodiment of the present invention moves toward a press machine.

Exemplary embodiments of the present invention will be described below with reference to the attached drawings. It should be noted that components of a second exemplary embodiment described below or later which are identical or correspond to those of the following first exemplary embodiment will be denoted by the same reference numerals, a detailed explanation for which will be omitted or simplified.

1. First Exemplary Embodiment

Figure 2:
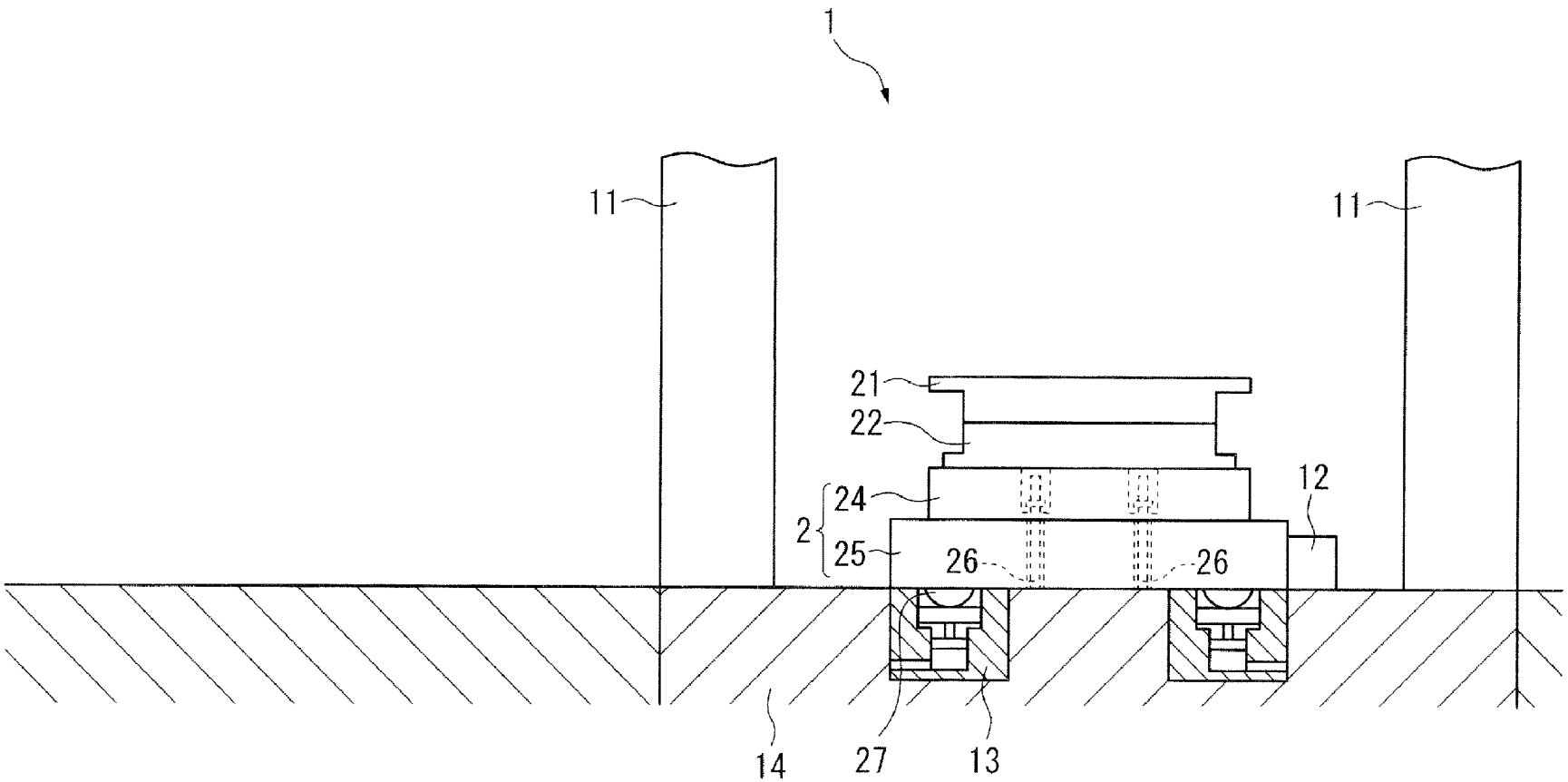
FIG. 2 is a schematic view showing a moving bolster grounded in a press machine.
Figure 3:
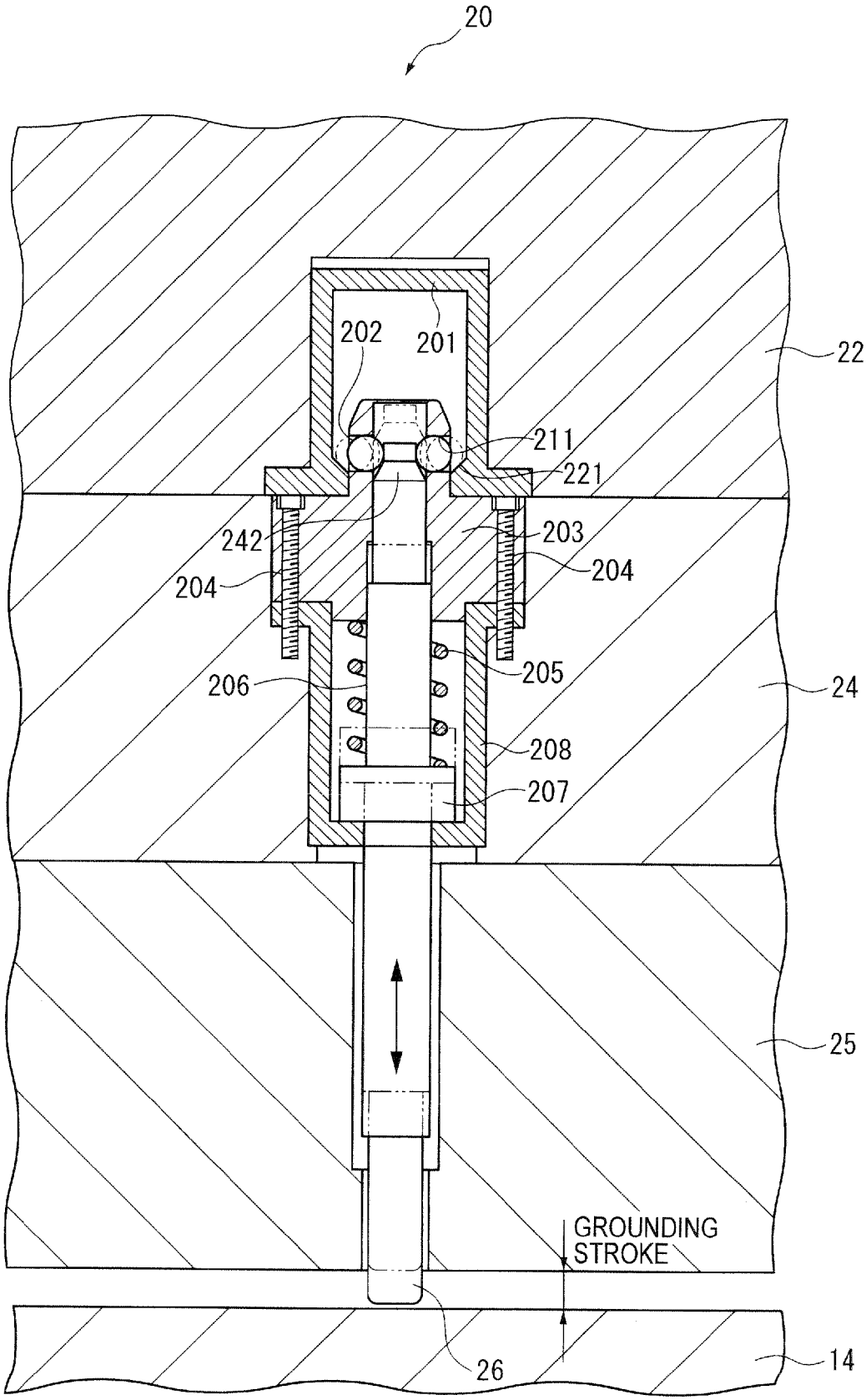
FIG. 3 is a cross-sectional view showing the first exemplary embodiment.

FIGS. 1 and 2 are schematic views showing a moving bolster 2 moving toward a press machine 1 to be grounded thereon. FIG. 3 is a cross-sectional view taken along III-III line in FIG. 1, showing a first exemplary embodiment of a die clamp mechanism 20 according to the present invention.

FIG. 1 shows the moving bolster 2 moving toward a bed 14 of the press machine 1. The moving bolster 2 includes a bolster 24 and a carrier 25. An upper die 21 and a lower die 22 are mounted on the moving bolster 2. The press machine 1 includes four uprights 11 (only two uprights are shown in FIG. 1) provided on the bed 14, a crown, a slide (not shown) and the like. A moving bolster stopper 12 (hereinafter referred to as an MB stopper 12) as a stopper for the moving bolster 2 and a moving bolster lifter 13 (hereinafter referred to as an MB lifter 13) where the moving bolster 2 is grounded are provided on the bed 14.

FIG. 2 shows the moving bolster 2 grounded on the MB lifter 13 provided on the bed 14. At this time, the hydraulic MB lifter 13 is retracted so that a wheel 27 is accommodated in the MB lifter 13. At the same time, a shaft 206 (See FIG. 3) protruding from a lower edge of the carrier 25 is abutted on the bed 14 and plunged into the carrier 25. The shaft 206 is a component of the die clamp mechanism 20.

Next, the die clamp mechanism 20 will be described with reference to FIG. 3.

As shown in FIG. 3, the die clamp mechanism 20 includes a sleeve 201, an insert member 203, the shaft 206 as a plunger, a spring 205 attached to the shaft 206, and an accommodating member 208.

The sleeve 201 of the die clamp mechanism 20 is cylindrical and fitted into a concave portion of the lower die 22 from below. An engagement portion 221 protruding inward is provided on a lower portion of the sleeve 201, and respective upper ends of the insert member 203 and the shaft 206 are inserted into a hole provided on a bottom side of the sleeve 201.

The insert member 203, which is tubular and has a truncated conical upper end, is fixed to the bolster 24 by a bolt 204 from above while the insert member 203 is accommodated in a through hole of the bolster 24. A plurality of accommodating portions 211 horizontally penetrating inside and outside the insert member 203 are provided in the vicinity of an upper end of the insert member 203 to accommodate a ball 202.

The shaft 206 is accommodated in through holes of both the carrier 25 and bolster 24. The shaft 206 axially slides, an upper end of which penetrates the insert member 203. A crank portion 242 having a tapered portion and a small-diameter portion which are in contact with the ball 202 is provided on the upper end of the shaft 206. The ball 202 is moved into and out of the accommodating portion 211 in accordance with the axial movement of the shaft 206. While the shaft 206 is pushed down, the ball 202 is accommodated in the accommodating portion 211. While the shaft 206 is pushed up, the ball 202 is pushed out of the accommodating portion 211 to be engaged with the engagement portion 221 positioned on the lower portion of the sleeve 201. A lower end of the shaft 206 is a locating pin 26 that protrudes from the carrier 25.

The spring 205 is located between a lower side of the insert member 203 and a spring stopper 207 provided in the middle of the shaft 206 to bias the shaft 206 downward.

The accommodating member 208 is cylindrical and accommodated in a through hole of the bolster 24 while the accommodating member 208 is attached to a lower portion of the insert member 203. The spring stopper 207, which is penetrated by the shaft 206, is abutted on a bottom side of the accommodating member 208 to define the amount of protrusion from a lower side of the carrier 25.

Next, operation of the die clamp mechanism 20 will be described with reference to FIGS. 2 and 3.

As shown in FIG. 2, the moving bolster 2 is moved toward the press machine 1 and grounded on the MB lifter 13, whereby the locating pin 26 of the shaft 206 is abutted on the bed 14 and pushed up.

When the locating pin 26 is pushed up by the bed 14, the shaft 206 is pushed up against the spring force of the spring 25 by a grounding stroke, i.e. a length of a protruded portion of the locating pin 26. Accordingly, the ball 202 is brought into contact with the crank portion 242 to be pushed out of the accommodating portion 211 in accordance with the upward movement of the shaft 206, and is engaged with the engagement portion 221 provided in the bolster 24. Consequently, the lower die 22 is automatically clamped by the die clamp mechanism 20 using the sleeve 201, and also by the moving bolster 2.

On the other hand, when the MB lifter 13 is moved upward and the lower side of the carrier 25 is floated from the bed 14, the shaft 206 is pushed down by the spring 205. Accordingly, the moving bolster 2 is separated from the bed 14 and the ball 202 engaged with the engagement portion 221 is accommodated in the accommodating portion 211 so that the lower die 22 is automatically unclamped.

As can be understood by the above description, no clamp mechanism having hydraulic source or the like is necessary for clamping the lower die 22. Besides, unmanned operation for clamping and unclamping the moving bolster 2 can be realized. In preparatory process, the upper die 21 and lower die 22 are connected to each other so that the upper die 21 and lower die 22 can be simultaneously lifted up when only one of the upper die 21 and lower die 22 is lifted up, which allows easy replacement of a die. Consequently, cost of the die clamp mechanism and also time for preparatory process can be reduced.

2. Second Exemplary Embodiment

Figure 4:
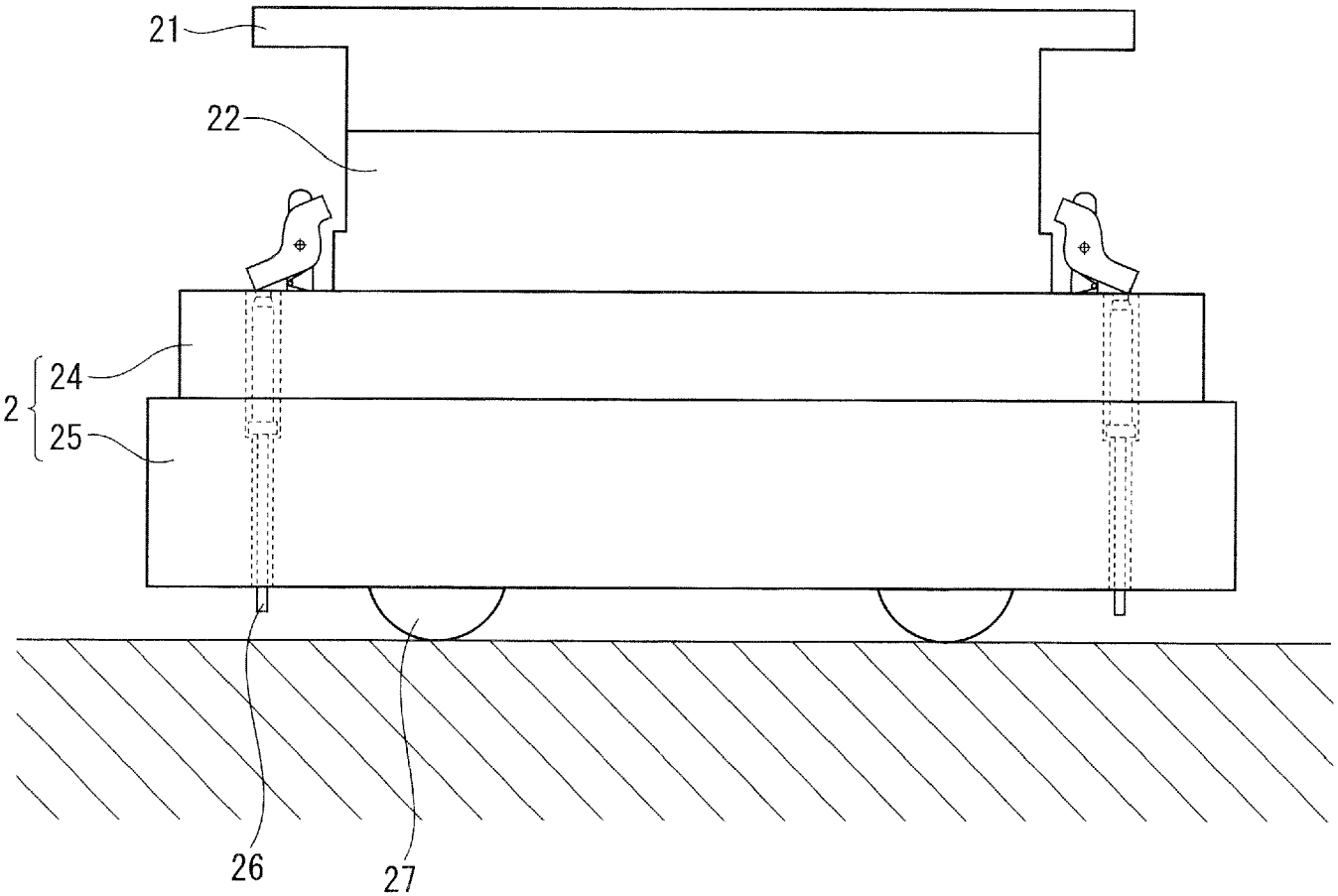
FIG. 4 shows a moving bolster according to a second exemplary embodiment.
Figure 5:
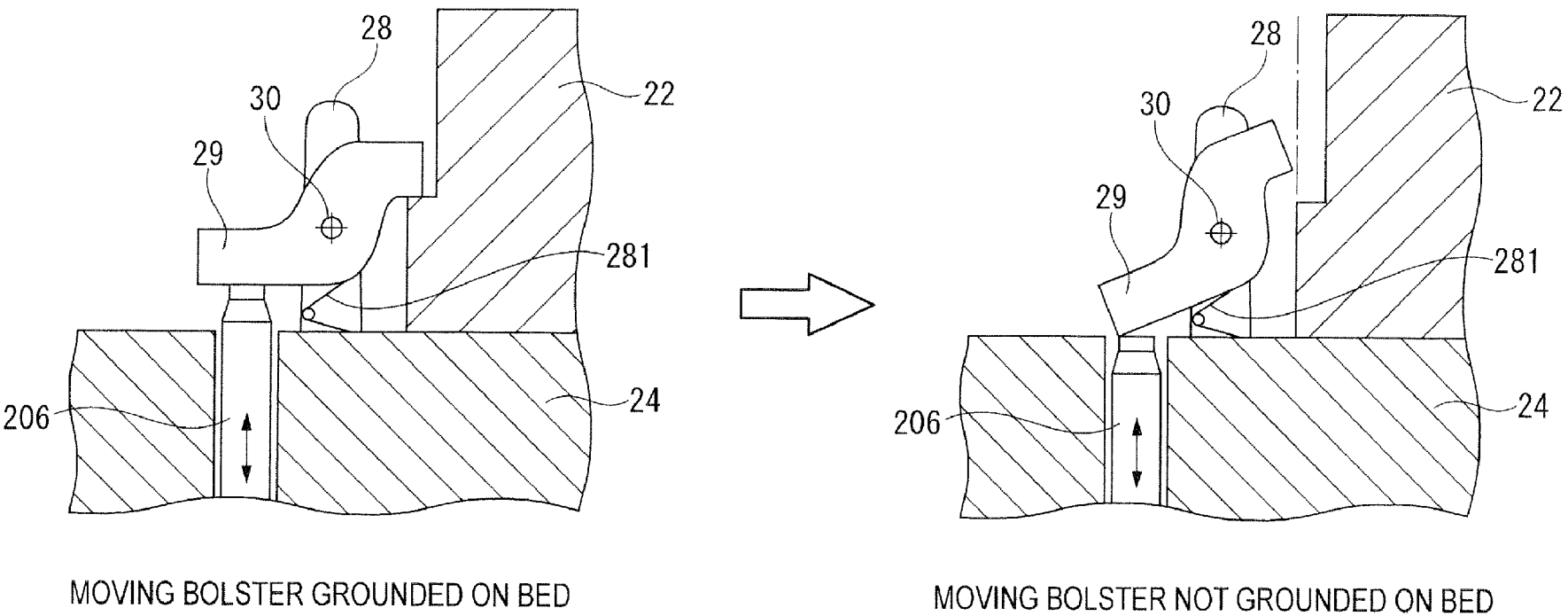
FIG. 5 is an enlarged view of a primary part in FIG. 4.

FIG. 4 shows a moving bolster 2 according to a second exemplary embodiment of the present invention and FIG. 5 is an enlarged view of a primary part in FIG. 4. In the second exemplary embodiment, an arrangement of the die clamp mechanism 20 and a position of the die clamp mechanism 20 in the moving bolster 2 are different from those of the first exemplary embodiment. Specifically, the die clamp mechanism 20 of the first exemplary embodiment is completely buried in the moving bolster 2, while levers 29 are provided in the vicinity of four corners of an upper side of the bolster 24 such that both ends of the shaft 206 which are a part of the die clamp mechanism 20 protrude according to the second exemplary embodiment.

An arrangement different from that of the moving bolster 2 of the first exemplary embodiment will be described with reference to FIG. 5. In the second exemplary embodiment, the die clamp mechanism 20 includes a supporting member 28 that protrudes upward from the upper side of the bolster 24, the lever 29 connected to the supporting member 28 by a pin 30, and a spring 281 located between a lower side of the lever 29 and the upper side of the bolster 24.

Since the lever 29 is connected to the supporting member 28 by the pin, the lever 29 is rotatable about the pin 30. The spring 281 biases an end portion of the lever 29 close to the lower die 22 in a lift-up direction (counterclockwise in FIG. 5).

Similarly to the first exemplary embodiment, when the moving bolster 2 is grounded in accordance with the downward movement of the MB lifter 13 provided on the bed 14, the locating pin 26 is pushed up by the bed 14 and the shaft 206 inserted into the through hole of the bolster 24 protrudes from the upper side of the bolster 24 as showed in FIG. 2. Accordingly, the shaft 206 is abutted on a lower side of one end of the lever 29 in a knocking-up manner, and the lever 29 is inclined toward the lower die 22. Consequently, the other end of the lever 29 is engaged with the lower die 22 so that the lower die 22 is clamped.

On the other hand, when the lower side of the carrier 25 is floated from the bed 14 in accordance with the upward movement of the MB lifter 13, the shaft 206 is moved down by the weight of the shaft 206 itself and the spring force of the spring 205 and the lever 29 is pushed up by the spring 281. Accordingly, the other end of the lever 29 is disengaged from the lower die 22 so that the lower die 22 is unclamped. At this time, the lever 29 is located on a side close to the lever 29 relative to the dashed-dotted line depicted upwardly along the lower die 22, whereby the lower die 22 is lifted up without clashing with the lever 29. Here, the shaft 206 has a portion (not shown) corresponding to the spring stopper 207 of the first exemplary embodiment to define the amount of protrusion from the lower side of the carrier 25.

As can be understood by the above description, in this arrangement, the shaft 206 slides axially in accordance with the movement of the moving bolster 2, which allows unmanned operation of the moving bolster 2 for clamping and unclamping the lower die 22. Consequently, this arrangement offers the same advantage as those of the first exemplary embodiment.

3. Third Exemplary Embodiment

Figure 6:
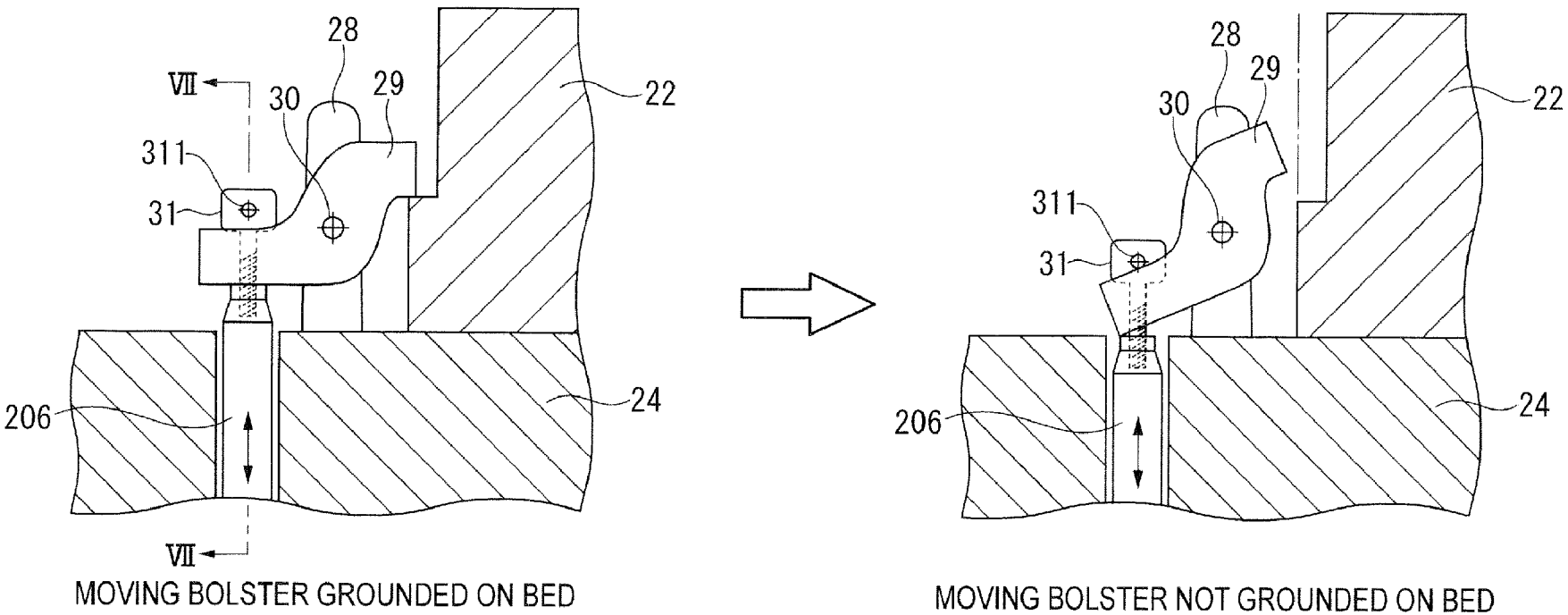
FIG. 6 is an enlarged view of a primary part according to a third exemplary embodiment.
Figure 7:
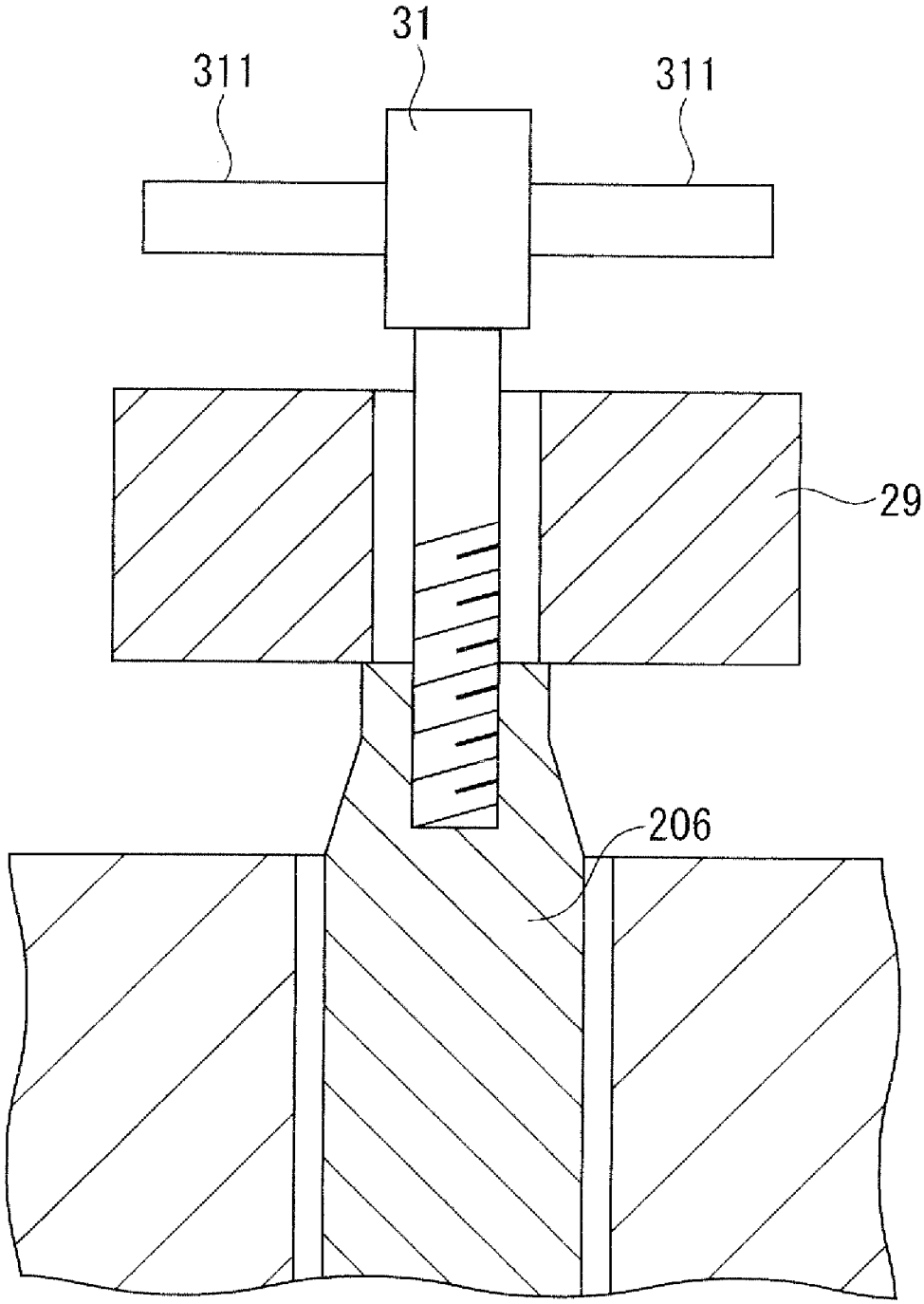
FIG. 7 is a cross-sectional view taken along VII-VII line in FIG. 6.

FIG. 6 is an enlarged view of a primary part of a moving bolster 2 according to a third exemplary embodiment of the present invention and FIG. 7 is a cross-sectional view taken along VII-VII line in FIG. 6.

A die clamp mechanism 20 of the third exemplary embodiment is a modification of the second exemplary embodiment. Specifically, in this arrangement, the spring 281 located on the lower side of the lever 29 of the second exemplary embodiment is not utilized. Instead, the lever 29 is rotated to be disengaged by a connecter 31 that is a shaft screwed on an upper end of the shaft 206 from above. An arrangement different from that of the second exemplary embodiment will be described below with reference to FIGS. 6 and 7.

A press pin 311 protrudes horizontally from both sides on an upper end of the connecter 31. A portion of the connector 31 which is not screwed to the shaft 206 is inserted into a notched portion of the lever 29.

In this arrangement, as shown in FIG. 2, when the lower side of the carrier 25 is floated from the bed 14 to be separated from the bed 14 in accordance with the upward movement of the MB lifter 13 provided on the bed 14, the shaft 206 is moved down by the weight of the shaft 206 itself and the spring force of the spring 205 so that the connector 31 screwed to an upper portion of the shaft 206 is also moved down. While an upper portion of the connector 31 is accommodated in the notched portion of the lever 29, the lever 29 is pushed down by the press pin 311. Accordingly, the lever 29 is rotated about the pin 30 counterclockwise to be pushed up. Consequently., the lever 29 is disengaged from the lower die 22 so that the lower die 22 is unclamped.

Operation of the lever 29 for clamping the lower die 22 will be omitted because it is similar to that of the second exemplary embodiment.

As can be understood by the above description, in this arrangement, unmanned operation of the moving bolster 2 for clamping and unclamping the lower die 22 can be realized similarly to the first and second exemplary embodiments. Consequently, this arrangement offers the same advantages as those of the first and second exemplary embodiments.

4. Forth Exemplary Embodiment

Figure 8:
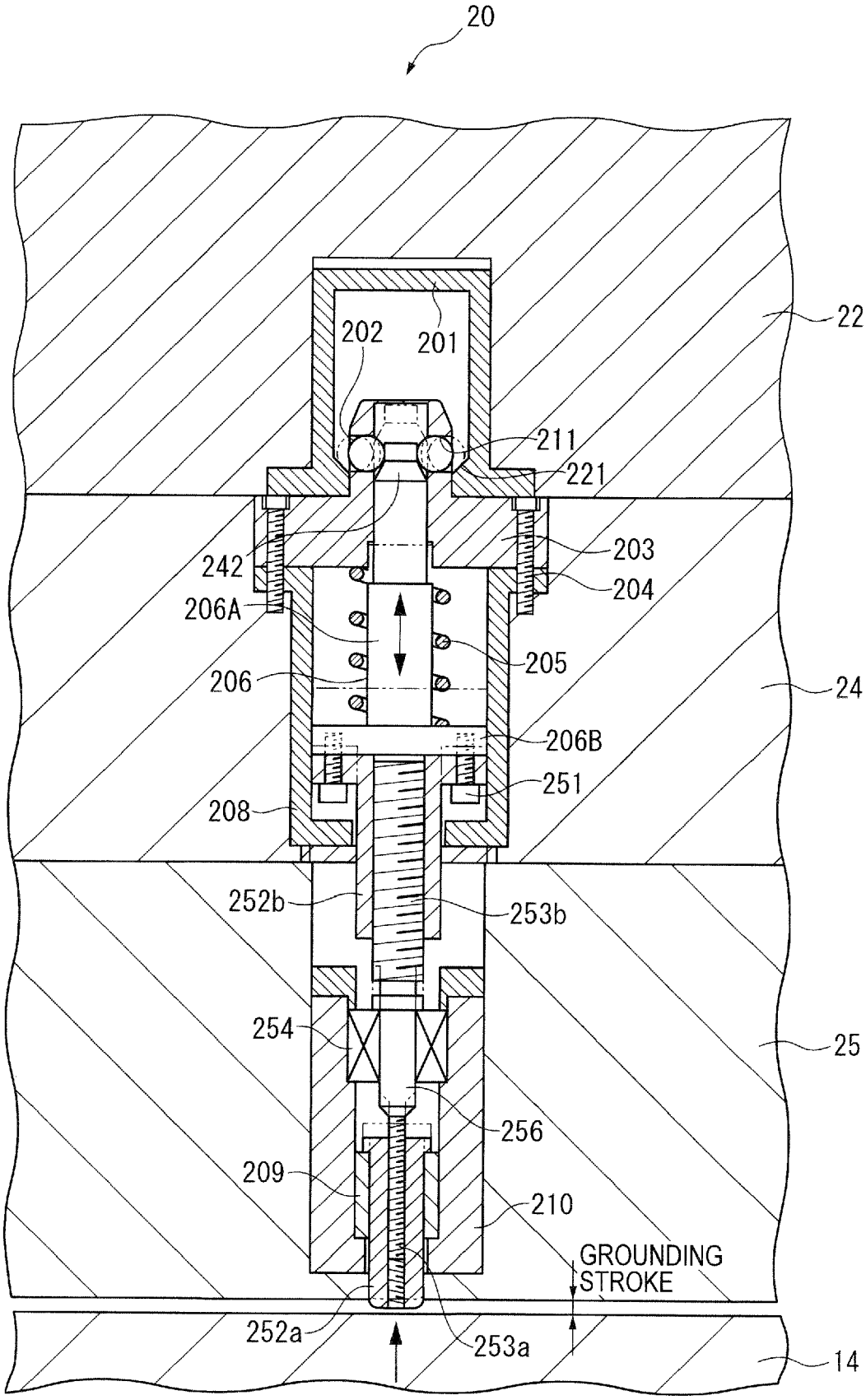
FIG. 8 is a cross-sectional view showing a fourth exemplary embodiment.

FIG. 8 shows a forth exemplary embodiment of a die clamp mechanism 20 according to the present invention. In the forth exemplary embodiment, a grounding stroke is shorter than that of the first exemplary embodiment.

An arrangement different from that of the die clamp mechanism 20 of the first exemplary embodiment will be described with reference to FIG. 8. In this arrangement, the shaft 206 of the die clamp mechanism 20 includes a first nut member 252*a* as a locating pin, a screw member 256, a second nut member 252*b* and a plunger 206A. The first nut member 252*a* protrudes from the lower side of the carrier 25 and screwed to a first trapezoidal screw 253*a* provided on a lower portion of the screw member 256. A bush 209 is penetrated by the first nut member 252*a*. The bush 209 functions as a rotation stopper, which allows only axial movement of the first nut member 252*a* and prevents the first nut member 252*a* from being rotated.

The screw member 256 includes the small-diameter first trapezoidal screw 253*a* on a lower side and a large-diameter second trapezoidal screw 253*b* on an upper side, where each lead of the first trapezoidal screw 253*a* and the second trapezoidal screw 253*b* is different. In this arrangement, the lead of the second trapezoidal screw 253*b* is about third times longer than that of the first trapezoidal screw 253*a*. However, a ratio of lengths of such leads varies depending on a grounding stroke length and the ratio is not limited thereto. The screw member 256 is rotatably supported by a bearing 254.

The second nut member 252*b* is screwed to the second trapezoidal screw 253*b* provided on the screw member 256 and is fastened on a lower side of the plunger 206A by a bolt 251.

The plunger 206A has the same shape as the upper portion of the shaft 206 of the above-described first exemplary embodiment. A stopper 206B is provided on a lower end of the plunger 206A. The spring 205 is provided between the stopper 206B and the insert member 203. The plunger 206A, the second nut member 252*a* and the screw member 256 are biased toward the bearing 254 by the spring 205.

Similarly to the first exemplary embodiment, when the moving bolster 2 is moved toward the press machine 1 to be grounded thereon, the first nut member 252*a* is pushed up by the bed 14. Accordingly, the first nut member 252*a* is pushed up against the spring force of the spring 205 so that the first trapezoidal screw 253*a*, i.e. the screw member 256, is rotated. Simultaneously, the second trapezoidal screw 253*b* which is a part of the screw member 256 is rotated so that the second nut member 252*b* is moved upward. Consequently, the plunger 206A is pushed up in accordance with an upward movement of the second nut member 252*b* and the ball 202 is pushed outward to be engaged with the engagement portion 221 so that the lower die 22 is automatically clamped by the moving bolster 2.

On the other hand, when the lower side of the carrier 25 is floated from the bed 14 in accordance with the upward movement of the MB lifter 13, the plunger 206A is pushed down by the spring 205. Simultaneously, the second trapezoidal screw 253*b*, i.e. the screw member 256, is rotated and the first nut member 252*a* is moved downward. Accordingly, the moving bolster 14 is separated from the bed 14 and the ball 202 engaged with the engagement portion 221 is accommodated in the accommodating portion 211 so that the lower die 22 is automatically unclamped.

As can be understood by the above description, since the two screws which have different leads, i.e. the first trapezoidal screw 253*a* and the second trapezoidal screw 253*b*, are utilized, the second nut member 252*b* is moved for a relatively long distance when the rotation of the first trapezoidal screw 253*a* which has a small-diameter lead is transmitted to the second trapezoidal screw 253*b* which has a large-diameter lead. Thus, a distance for being pushed up by the shaft 206 is adequately secured even when the grounding stroke is short. Consequently, this arrangement offers the same advantages as those of the first exemplary embodiment.

5. Fifth Exemplary Embodiment

Figure 9:
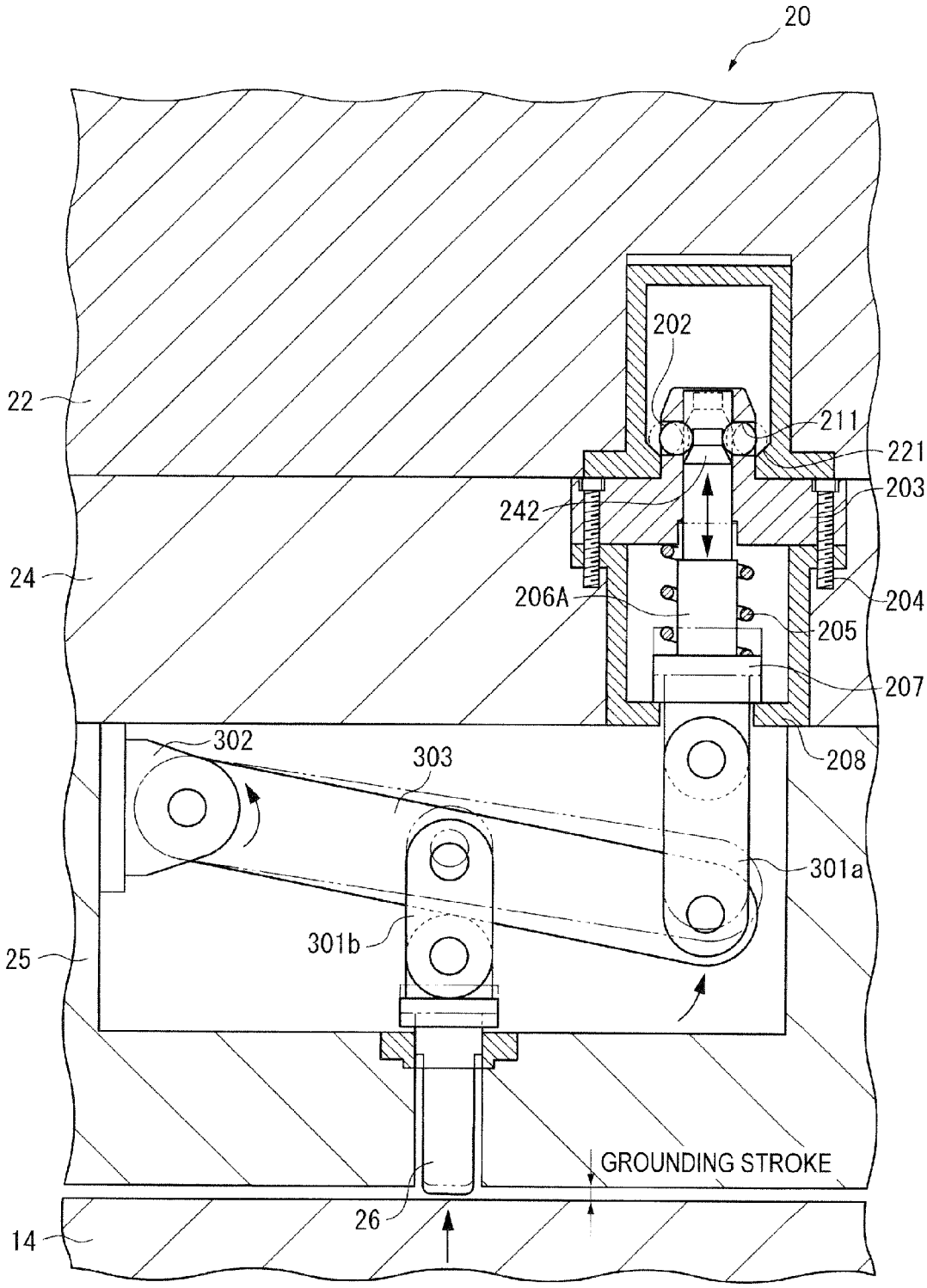
FIG. 9 is a cross-sectional view showing a fifth exemplary embodiment.

FIG. 9 shows a fifth exemplary embodiment according to the present invention. In the fifth exemplary embodiment, a grounding stroke is short similarly to the fourth exemplary embodiment.

An arrangement different from that of the die clamp mechanism 20 of the first and fourth exemplary embodiments will be described with reference to FIG. 9. In the fifth exemplary embodiment, a link mechanism is provided on a lower portion of the plunger 206A for the die clamp mechanism 20. The link mechanism includes a first link member 301*a*, a second link member 301*b*, a link supporting member 302 and a swinging link member 303.

Specifically, the lower portion of the plunger 206A and an upper portion of the first link member 301*a* are pin-connected. A lower portion of the first link member 301*a* is pin-connected to one end of the swinging link member 303. An upper portion of the second link member 301*b* is pin-connected to a middle portion of the swinging link member 303 in a longitudinal direction, and a lower portion of the second link member 301*b* is pin-connected to the locating pin 26. The link supporting member 302 is attached to an inner wall of the carrier 25 and connected to the other end of the swinging link member 303.

In the above-described link mechanism, the swinging link member 303 swings around the link supporting member 302 in accordance with an upward movement of the second link member 301*b*, and simultaneously the first link member 301*a* is moved upward.

In this arrangement, when the locating pin 26 is pushed up by the bed 14, the second link member 301*b* is pushed up and the swinging link member 303 connected to the second link member 301*b* by the pin is also pushed up. Simultaneously, the swinging link member 303 is rotated counterclockwise about the link supporting member 302. Accordingly, the first link member 301*a* connected to one end of the swinging link member 303 is moved upward. The subsequent movement of the plunger 206A is the same as that of the second exemplary embodiment. Thus, the lower die 22 is automatically clamped by the moving bolster 2.

On the other hand, when the lower side of the carrier 25 is floated from the bed 14 in accordance with the upward movement of the MB lifter 13, the first link member 301*a* is pushed down through the plunger 206A by the spring 205. Simultaneously, the swinging link member 303 is rotated counterclockwise about the link supporting member 302 and the second link member 301*b* is pushed down. Accordingly, the moving bolster 14 is separated from the bed 14 and the ball 202 engaged with the engagement portion 221 is accommodated in the accommodating portion 211, whereby the lower die 22 is automatically unclamped.

In the above-described link mechanism, a movement of the first link member 301*a* is amplified relative to a movement of the second link member 301*b* in accordance with a ratio of a distance between a rotation center that is a connecting position to the link supporting member 302 and the first link member 301*a*, and a distance between the rotation center and the second link member 301*b* (i.e. a leverage). Thus, even with a short grounding stroke, a distance for being pushed by the plunger A can be increased. Consequently, this arrangement offers the same advantage as that of the first exemplary embodiment.

It should be noted that the present invention is not limited to the embodiments described above, but includes other arrangements or the like that can achieve an object of the present invention, and also include modifications as shown below.

For example, a ball screw may be used instead of the trapezoidal screw in the second exemplary embodiment.

Although one die clamp mechanism 20 is used in the respective embodiments described above, a plurality of die clamp mechanisms 20 may be used.

The die clamp mechanism 20 may be provided in the moving bolster 2, but also a part or whole of the die clamp mechanism 20 may be exposed out of the moving bolster Although a coil spring as the spring 205 is used as a biasing member to bias the plunger 206A downward in the embodiments described above, a coned disc spring or an elastic body such as a rubber and urethane resin may be used. Any members that have a function to expand and contract in accordance with a stroke distance of the plunger 206A and bias the plunger 206A downward may be used as the biasing member.

Although the lower die 22 is mounted on the upper side of the bolster 24 and is clamped by the die clamp mechanism 20 in the embodiments described above, the lower die 22 may be Fixed on an upper side of a common plate mounted on the upper side of the bolster 24 and then the common plate may be clamped by the die clamp mechanism 20. At this time, a die may be replaced by lifting up the common plate as a part of the die in preparatory process.

The priority application Number JP2007-201837 upon which this patent application is based is hereby incorporated by reference.

What is claimed is:

1. A die clamp mechanism for a press machine, comprising:

a plunger arranged to protrude from a lower surface of a carrier toward a bed of the press machine when the carrier is raised so that the lower surface of the carrier is separated from an upper surface of the bed, and to retract into the carrier when the lower surface of the carrier is grounded on the upper surface of the bed;

a bias member that biases the plunger downward to enable the plunger to protrude from the lower surface of the carrier and retract into the carrier; and an engaging member that engages a die with an upper side of a bolster mounted on the carrier in response to an axial movement of the plunger when the plunger retracts into the carrier.

2. The die clamp mechanism for the press machine according to claim 1, further comprising:

a concave portion provided on a lower side of the die; and an insert member that protrudes upward from the upper side of the bolster and that is inserted into the concave portion from below when the die is mounted on the upper side of the bolster, wherein the engaging member engages the die with the insert member in response to the axial movement of the plunger when the plunger retracts into the carrier.

3. The die clamp mechanism for the press machine according to claim 2, wherein:

an engagement portion engaged with the engaging member is provided on a lower portion of the concave portion, an axial through hole into which the plunger is insertable and a plurality of horizontal ball-accommodating portions penetrating from an inner circumference to an outer circumference of an upper end of the insert member are provided in the insert member, the engaging member comprises a plurality of balls, each accommodated in a respective one of the ball-accommodating portions, a small-diameter portion is provided on an upper end of the plunger, and each of the balls is brought into contact with the small-diameter portion and plungeable from an outer circumference of the plunger when the plunger protrudes from the lower surface of the carrier, and each of the balls is brought into contact with the outer circumference of the insert member which has a diameter larger than the small-diameter portion and protrudes from the outer circumference of the plunger to be engaged with the engagement portion when the plunger retracts into the carrier.

4. The die clamp mechanism for the press machine according to claim 1, wherein:

the engaging member comprises a lever abutted on an upper end of the plunger, the die clamp mechanism further comprises a supporting member that connects the lever by a pin, and the lever is disengaged from the die when the plunger protrudes from the lower surface of the carrier and the lever is pushed up by the plunger to be engaged with the die when the plunger retracts into the carrier.

5. The die clamp mechanism for the press machine according to claim 1, wherein:

the engaging member comprises a lever abutted on an upper end of the plunger, the die clamp mechanism further comprises a connector screwed on an end portion of the plunger through the lever and a pressing member that protrudes on an upper end of the connector, and the lever is pushed down to be disengaged from the die when the plunger protrudes from the lower surface of the carrier and the lever is pushed up by the plunger to be engaged with the die when the plunger retracts into the carrier.

6. The die clamp mechanism for the press machine according to claim 1, further comprising:

a first nut member provided protrudably and retractably from the lower surface of the carrier:

a screw member a lower portion of which is screwed to the first nut member; and a second nut member screwed to an upper portion of the screw member, wherein the second nut member is attached to the plunger, and a lead of the second nut member is longer than a lead of the first nut member.

7. The die clamp mechanism for the press machine according to claim 1, further comprising:

a locating pin provided protrudably and retractably from the lower surface of the carrier; and a link mechanism that transfers an axial movement of the locating pin to the plunger, wherein the link mechanism includes a first link member an upper portion of which is attached to the plunger, a swinging link member pivotally attached to a lower portion of the first link member at a first end and swinging around a second end, and a second link member, an upper portion of which is connected to a middle portion of the swinging link member in a longitudinal direction and a lower portion of which is attached to the locating pin.

* * * * *